US005176270A

United States Patent [19]

Battagazzore

[11] Patent Number: 5,176,270

[45] Date of Patent: Jan. 5, 1993

[54] TAMPERPROOF CLOSURE FOR BOTTLES AND THE LIKE

[75] Inventor: Piero Battagazzore, Alessandria, Italy

[73] Assignee: Guala S.p.A., Alessandria, Italy

[21] Appl. No.: 704,065

[22] Filed: May 22, 1991

[51] Int. Cl.[5] ..... B65D 41/34

[52] U.S. Cl. ..... 215/252

[58] Field of Search ..... 215/252, 253, 258

[56] References Cited

U.S. PATENT DOCUMENTS

| | | | |
|---|---|---|---|
| 2,423,582 | 7/1947 | Coleman | 215/252 |
| 3,464,576 | 9/1969 | Rohde | 215/252 |
| 4,305,516 | 12/1981 | Perne et al. | 215/252 |
| 4,534,479 | 8/1985 | Conti | 215/252 |
| 4,548,329 | 10/1985 | Curry | 215/216 |
| 4,573,601 | 3/1986 | Berglund | 215/252 |
| 4,744,479 | 5/1988 | Schöttli | 215/252 |
| 4,796,770 | 1/1989 | Begley | 215/252 |

FOREIGN PATENT DOCUMENTS

| | | | |
|---|---|---|---|
| 553475 | 2/1958 | Canada | 215/252 |
| 8905760 | 6/1989 | PCT Int'l Appl. | 215/252 |

*Primary Examiner*—Allan N. Shoap
*Assistant Examiner*—Stephen Cronin
*Attorney, Agent, or Firm*—Notaro & Michalos

[57] ABSTRACT

A tamperproof closure for a bottle and the like, which comprises a cap-type stopper adapted to be threaded over/off the bottle, a proofing band connected to the stopper by rupture bridge connections, and detents formed on the band for engagement with corresponding stops formed on the bottle, has the advantage of providing enhanced evidence of the bottle having been opened and positive removal of the band from both the bottle and the stopper, by virtue of the band being divided into at least two arcuate sections, and of a respective one of said detents being positioned close to each bridge connection for rupturing the bridge connection on the detent becoming engaged with a respective one of said stops while unscrewing the stopper for the first time.

3 Claims, 2 Drawing Sheets

TAMPERPROOF CLOSURE FOR BOTTLES AND THE LIKE

FIELD AND BACKGROUND OF THE INVENTION

This invention relates to a tamper-proof closure for a bottle and the like which includes a stopper which is threadable onto and off of the bottle, a proofing band connected to the stopper and having rupture bridge connections which can be broken to remove the band, and detents formed on the proofing band and engaged with corresponding stops on the bottle.

As is known, such closures, while being on the whole satisfactory and extensively utilized, still have the disadvantage of providing scant evidence of tampering, and on first use, they tend to behave in an uncertain, random fashion, that is to perform inconsistently.

Where the proofing band, once separated from the cap-type stopper, remains with the bottle, application of little skill is all that is required to re-attach it to the stopper and disguise the tampering.

In addition, the proofing band is intrusive during use of the bottle and may ultimately require removal for a possible recycling of the bottle.

Also, this band may on occasions come apart from the bottle during pouring, which is obviously objectionable.

It may also happen that the proofing band refuses to stay bonded to the bottle and is dragged around with the stopper due to some of its bridge connections failing to rupture. In this case, the proofing band would remain unevenly attached to the stopper and interfere every time the stopper is threaded back over the bottle neck, resulting in an untidy appearance and likely unexpected separation at some later time.

SUMMARY OF THE INVENTION

The underlying problem of this invention is to provide a closure as indicated which has suitable structural and functional features to obviate the aforementioned drawbacks.

This problem is solved by a closure as indicated but being characterized as in that the proofing band is divided into at least two arcuate sections with two bridge connections for each arcuate section, one positioned at a leading edge of the arcuate section and the other positioned at the trailing edge thereof. The detents of each arcuate section are set angularly apart from each other by a greater distance than an angular distance between the corresponding stops on the bottle. In this way, the detent at the trailing end of an arcuate section will engage its respective stop with a delay during which delay the arcuate section is compressed elastically.

BRIEF DESCRIPTION OF THE DRAWINGS

Further features and the advantages of a closure according to the invention will be apparent from the following detailed description of a preferred embodiment thereof, to be taken by way of non limitative example with reference to the accompanying drawings, in which.

DESCRIPTION OF PREFERRED EMBODIMENTS

Figure 1:
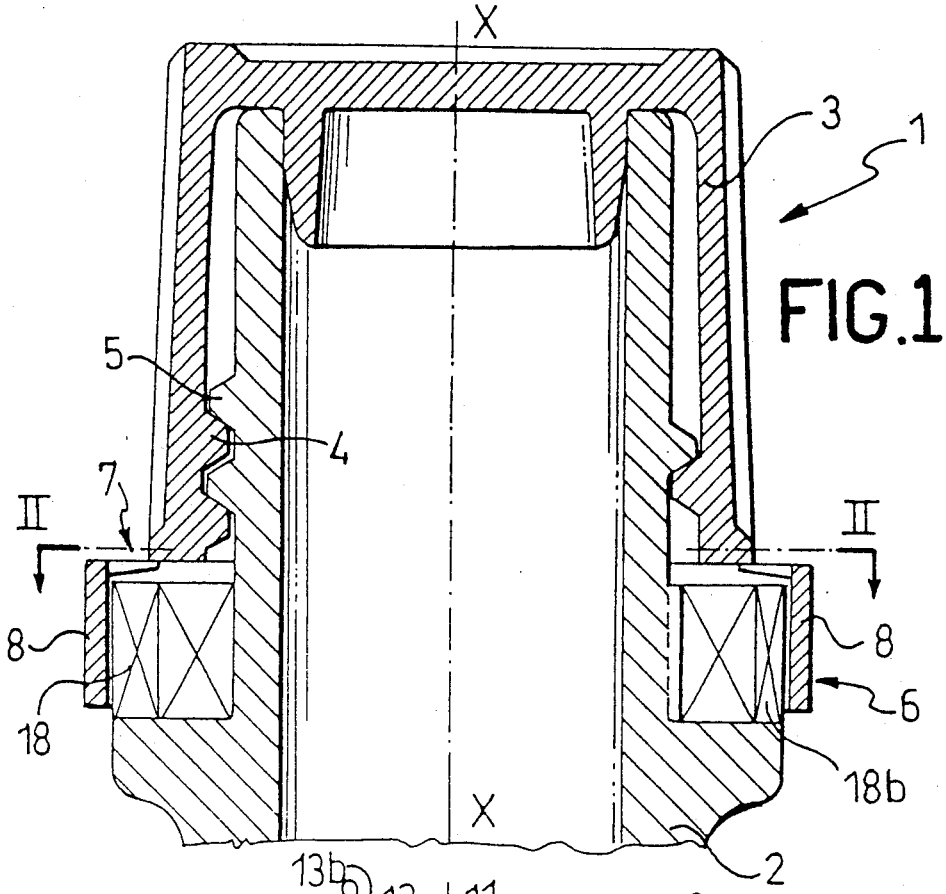
FIG. 1 is a sectional view in elevation of a closure according to the invention, taken along line I—I.

With reference to the drawing figures, generally shown at 1 is a tamperproof closure for a bottle 2.

This closure 1 comprises a cap-type stopper 3 having an axis X—X. A threadway 4 is provided on the stopper 3 inside, and a mating threadway 5 is provided on the bottle 2 outside. Thus, the stopper 3 can be threaded and unthreaded over/off the bottle 2 as required, by respectively turning it in the directions of arrows F and O.

Closure 1 further comprises a proofing band 6 formed integrally with the stopper 3 as by injection molding from a suitable plastics material. The proofing band 6 can be separated from the stopper 3 by the provision therebetween of a line of weakening 7 to be described.

On this closure 1, the proofing band 6 is divided into two equal arcuate sections, both referenced 8, each with an angular width which is slightly less than 180 degrees. Each arcuate section 8 has a leading end 9 and a trailing end 10 in the thread-out direction.

The ends 9 and 10 of either arcuate section 8 are contiguous to the ends 10 and 9, respectively, of the other arcuate section 8.

Two rupture bridge connections 11 and 12 extend between each arcuate section 8 and the stopper 3. It should be noted that the leading bridge connection locates close to the leading end 9 of the arcuate section, whereas the trailing bridge connection 12 locates close to the trailing end 10 of that same arcuate section.

Formed inwardly on each arcuate section 8 are two detents 13 and 14. It is notable that the leading detent 13 is positioned close to the leading bridge connection 11, and the trailing detent 14 close to the trailing bridge connection 12.

Detents 13 and 14 of each arcuate section 8 are set angularly apart by an angle A, e.g. of about 150 degrees.

Preferably, an auxiliary rupture bridge connection 15 (16) extends between the detent 13 (14) and the stopper 3.

Bridge connections 11 and 12, and auxiliary bridge connections 15 and 16, of either arcuate sections 8 jointly form the aforementioned line 7 of weakening.

Formed on the bottle 2, for each arcuate section 8, are two stops 17 and 18 adapted for engagement by the respective detents 13 and 14 on the arcuate section upon the stopper being turned in the thread-out direction of arrow F.

Said stops 17 and 18 are set angularly apart by an angle B, e.g. of 130 degrees.

Thus, angle A will exceed angle B by approximately 20 degrees in the example shown.

Detents 13 and 14 are preferably sawtooth-shaped, with a back 13*a*, 14*a* and a front 13*b*, 14*b*.

Likewise, stops 17 and 18 are sawtooth-shaped, with a back 17*a*, 18*a* and a front 17*b*, 18*b*.

The fronts form equal acute angles G with their respective tangent lines t, thereby to facilitate engagement of each detent with its respective stop.

It should be further noted that a thin rupture peduncle 19 is extended between the end 9 of one arcuate section 8 and the end 10 of the other, contiguous arcuate section 8 and is sized to be ruptured readier than the combination of the trailing bridge connection 12 and auxiliary trailing bridge connection 16.

Figure 2:
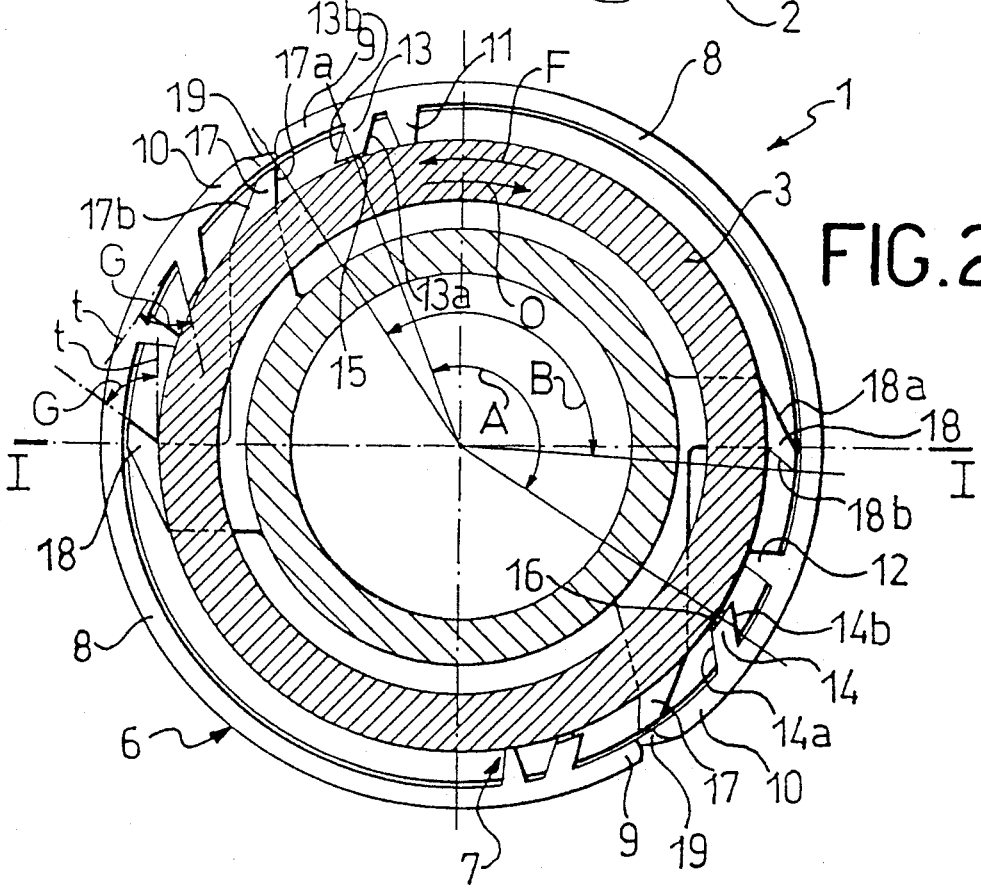
FIG. 2 is a sectional view through the closure in FIG. 1, taken along the line II—II.

The operation of the closure 1 according to the invention will be now described with reference to a starting condition, depicted in FIGS. 1 and 2, wherein the closure 1 has been installed on the bottle 2 after filling, such as by axial fitting or threading over in the direction of arrow O. Under this condition, the detents and stops overlap each other by mutual compliant engagement of their backs.

It is notable that in the starting condition, the detents 13 and 14 of each arcuate section 8 occupy positions angularly ahead of their respective stops 17 and 18.

Figure 3:
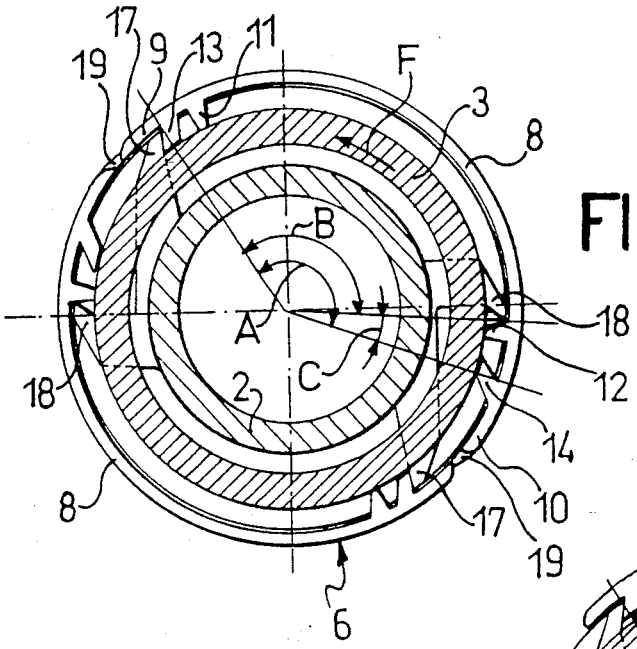
FIGS. 3, 4 and 5 are sectional views of the closure in FIGS. 1 and 2, drawn to a reduced scale and showing it at successive stages of its operation.
Figure 4:
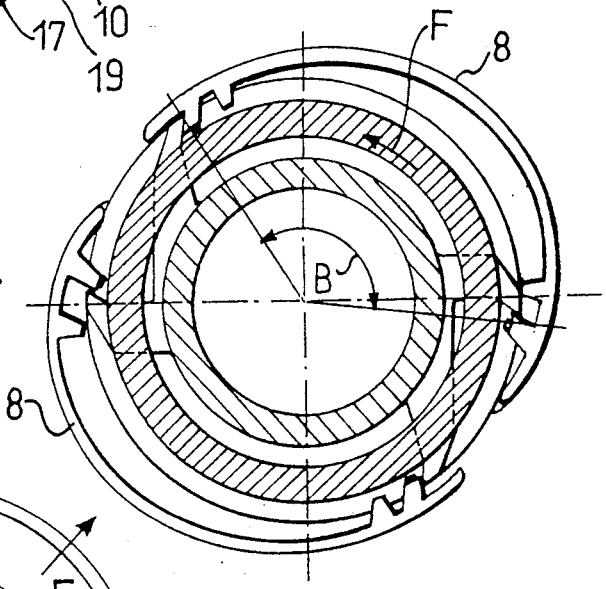
Figure 5:
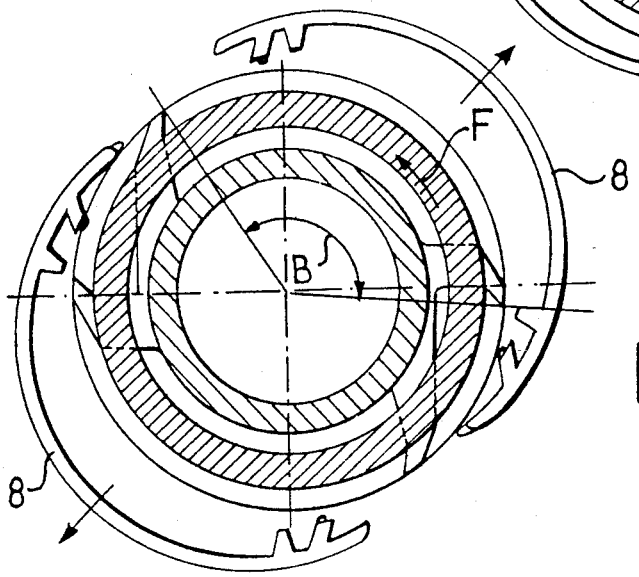

Opening is effected by threading out the stopper 3, as by turning it in the direction of arrow F. Following rotation through a short distance, the leading detent 13 will engage the stop 17 front-to-front (see FIG. 3).

Continued rotation results in the peduncles 19, leading bridge connection 11, and leading auxiliary bridge connection 15 of each arcuate section being immediately ruptured. Rupture of peduncle 19 and bridge connections 11 and 15 occurs in a most positive manner on account of they being located close to the detent, thereby the force is concentrated directly on them as, after engaging the detent 13 with the stop 17, the stopper is further threaded out with sufficient force.

On rupture, the leading end of each arcuate section will separate from the other section and the stopper, and remain attached to the bottle at the location of the leading stop.

As rotation is continued, there will occur front-to-front engagement of the trailing detent 14 with the stop 18, with an angular delay C equal to the angular difference between A and B of about 20 degrees.

During this delay C, the trailing end 10 of the arcuate section is brought closer to the leading end 9. In performing this movement, the arcuate section will be compressed and elastic energy be stored therein.

Further rotation will result in the trailing bridge connection 12 and auxiliary trailing bridge connection 16 being immediately ruptured. Once again, the rupture of bridge connections 12 and 16 is a positive one, for the reasons set forth above.

Following the rupture, the trailing end 10 of each arcuate section 8 will also separate from the stopper. Being no longer held to the stopper, and being compressed elastically between the stops 17 and 18, the arcuate section 8 will spring loose and release its stored elastic energy.

Continued rotation results in the stopper being threaded fully out and removed, for later threading on again according to necessity, with the proofing band fully and positively separated.

A major advantage of the closure according to this invention is that it can provide enhanced evidence of having been taken out and put back on. In fact, the proofing band can in no way be brought back against the stopper.

A further advantage of the inventive closure is that the bottle and stopper can be used more comfortably by virtue of the proofing band having been positively moved away.

Another advantage of the closure according to the invention comes from its dimensional stability, which will be retained for a long time by virtue of the peduncles and auxiliary bridge connections provided, effective to ensure that the arcuate sections are held in place to create the band.

Understandably, the closure described in the foregoing may be altered and modified in a number of ways by the skilled one to meet specific and contingent demands, without departing from the invention scope as set forth in the appended claims.

I claim:

1. A tamperproof closure plus bottle combination, comprising a cap-type stopper which is threadable onto the bottle in a first direction and off the bottle in an opposite second direction, a proofing band divided into at least two arcuate sections, each of said arcuate sections having a leading end and a trailing end in the second direction, each of said arcuate sections having two bridge connections connecting said band to said stopper, one of said bridge connections being at the leading end of said arcuate section and the other of said bridge connections being at the trailing end of said arcuate section, each of said arcuate sections having two detents, each of said detents being adjacent one of each of said bridge connections, said bottle having a stop for each of said detents and each said stop being sawtooth-shaped, said two detents on each of said arcuate sections being set angularly apart by a greater distance than an angular distance between each said stop corresponding to each of said detents so that said bridge connection at said leading edge of each said arcuate section is ruptured when said detent near said bridge connections to be ruptured engages a respective one of said stops when the stopper is first moved in the second direction and whereby said detent at said arcuate section trailing end will engage its respective stop with a delay during which said delay the arcuate section is compressed elastically.

2. A tamperproof closure combination according to claim 1, including an auxiliary rupture bridge connection extending between each of said detents and the stopper.

3. A tamperproof closure combination according to claim 2, including a thin rupture peduncle extending between contiguous ends of the arcuate sections and being sized to break ahead of the combination of one of said bridge connections and one of said auxiliary bridge connections.

* * * * *